United States Patent [19]

Sartor et al.

[11] Patent Number: 4,667,424

[45] Date of Patent: May 26, 1987

[54] SKI BOOT INCORPORATING A FLEX CONTROL DEVICE

[75] Inventors: Mariano Sartor, Montebelluna; Giorgio Baggio, S. Martino Di Lupari; Mirko Baratto, Valdobbiadene, all of Italy

[73] Assignee: Nordica S.p.A., Montebelluna-TV, Italy

[21] Appl. No.: 737,139

[22] Filed: May 23, 1985

[30] Foreign Application Priority Data

May 31, 1984 [IT] Italy ..... 21197 A/84

[51] Int. Cl.[4] ..... A43B 5/04

[52] U.S. Cl. ..... 36/120; 36/54; 36/121

[58] Field of Search ..... 36/117–121, 36/54

[56] References Cited

U.S. PATENT DOCUMENTS

| | | | |
|---|---|---|---|
| 3,786,581 | 1/1974 | Mochizuki | 36/121 |
| 3,868,783 | 3/1975 | Caporicci | 36/120 |
| 4,095,356 | 6/1978 | Robran et al. | 36/121 |
| 4,317,297 | 3/1982 | Hanson | 36/121 |
| 4,461,103 | 7/1984 | Annovi | 36/121 |
| 4,470,206 | 9/1984 | Annovi | 36/121 |
| 4,523,395 | 6/1985 | Borsoi | 36/119 |

FOREIGN PATENT DOCUMENTS

| | | | |
|---|---|---|---|
| 0133237 | 2/1985 | European Pat. Off. | 36/117 |
| 1810291 | 6/1970 | Fed. Rep. of Germany | 36/54 |

*Primary Examiner*—James Kee Chi

*Attorney, Agent, or Firm*—Guido Modiano; Albert Josif

[57] ABSTRACT

The ski boot incorporating a flex control device comprises a boot shell with which a front quarter and rear quarter are associated. An interference element is provided including a wedge-like body which is active between the shell and front quarter. The wedge-like body may be positioned adjustably by means of position adjusting means operative between the shell and the quarter to adjust the bias and displacement of the front quarter relatively to the shell.

11 Claims, 28 Drawing Figures

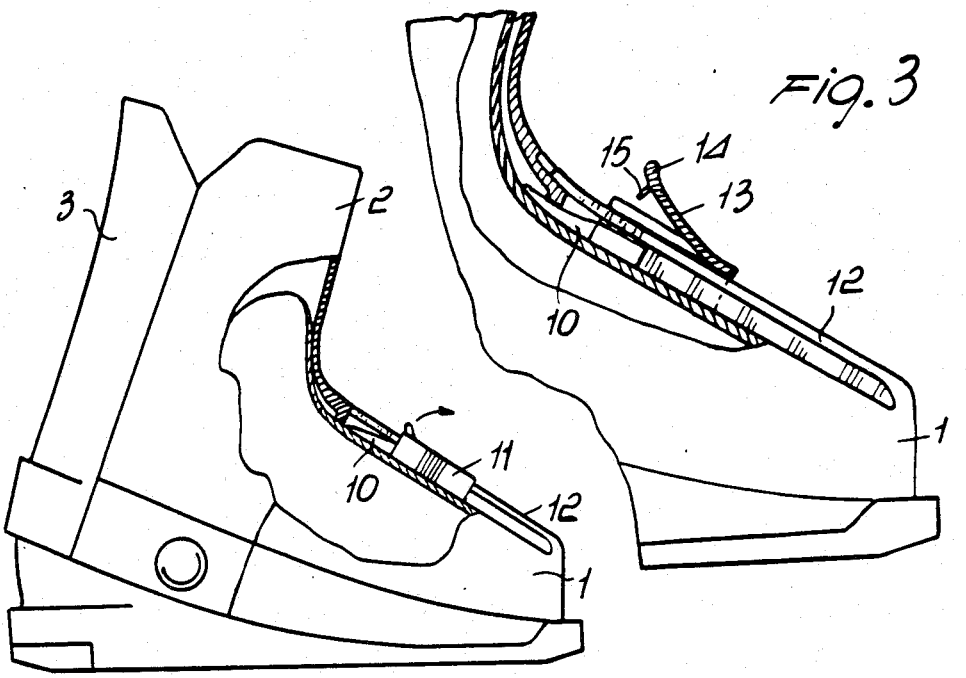
Fig. 2
Fig. 3
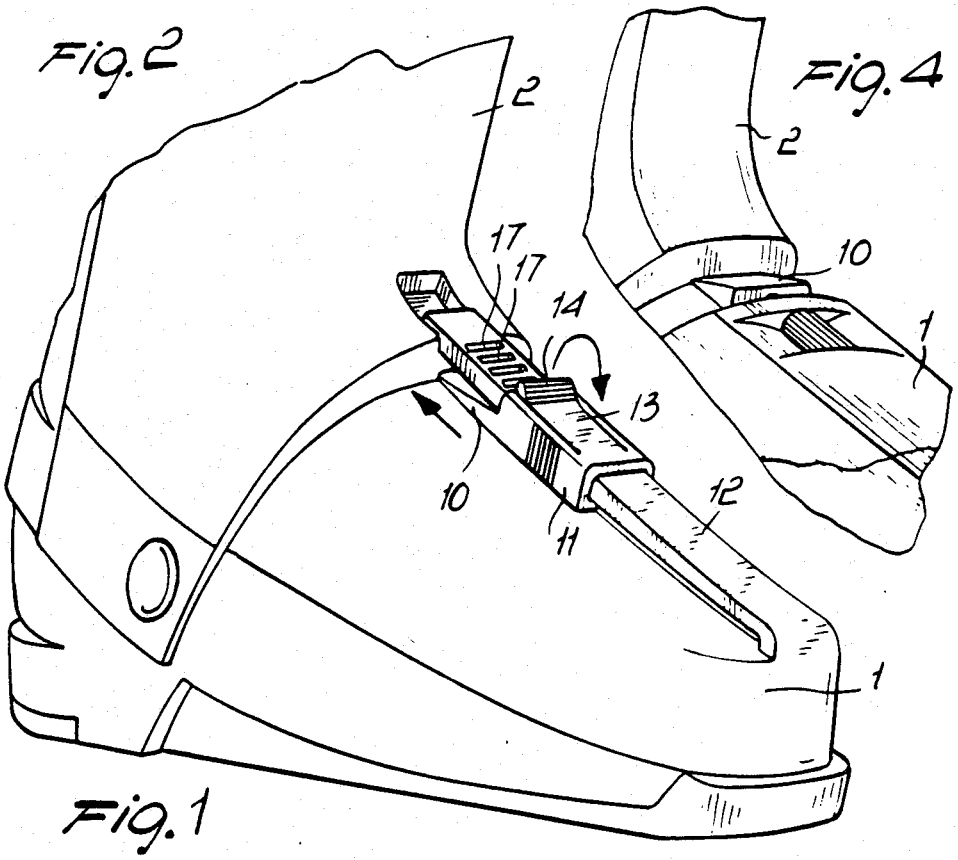
Fig. 1
Fig. 4

2
100
2a
10
20
23
21
2b
101
1

2
10
20
21
23
22
1

2
33
30
10
35
31
1

2
33
30
32
35
1

2
31
33
34
32
35
1

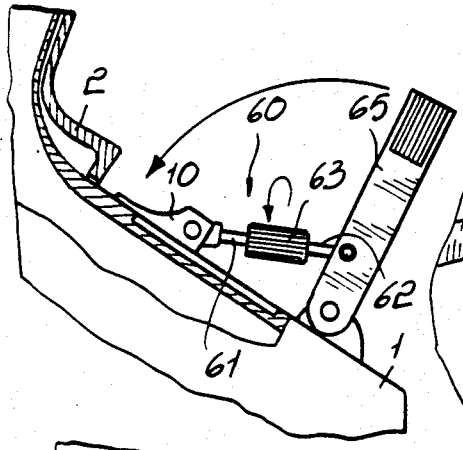
Fig. 19
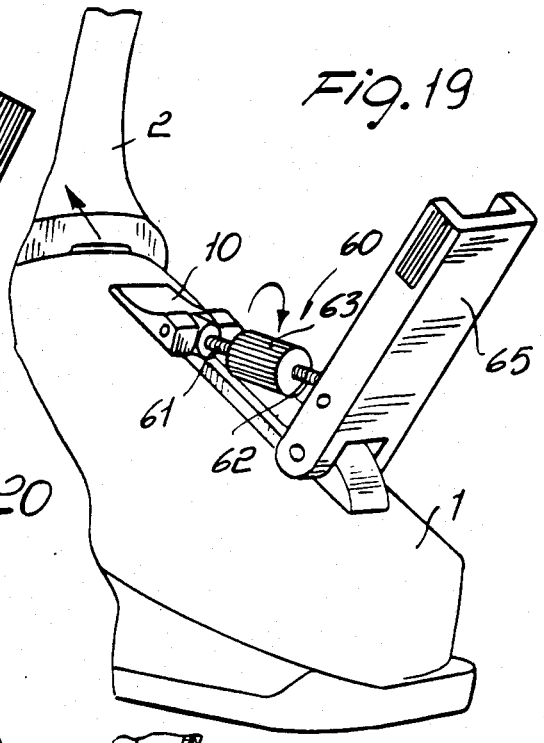
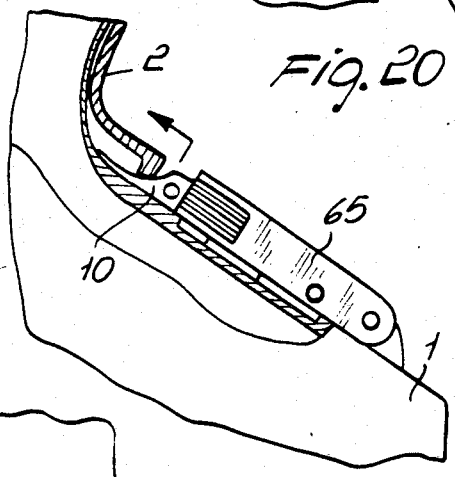
Fig. 20
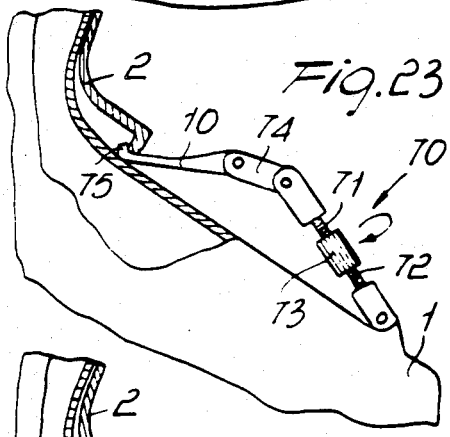
Fig. 23
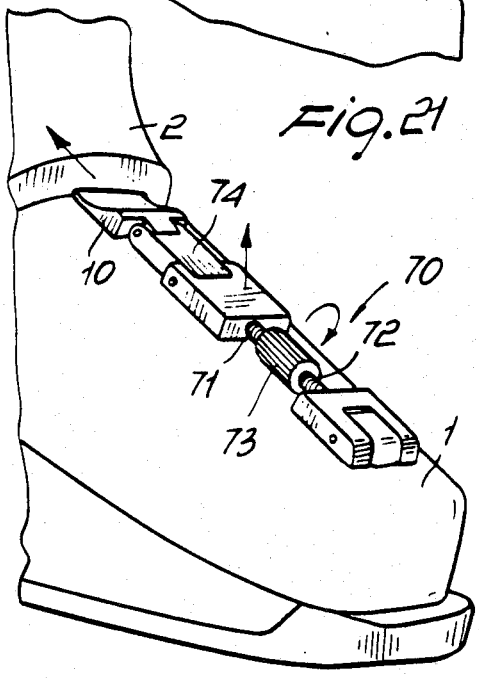
Fig. 21
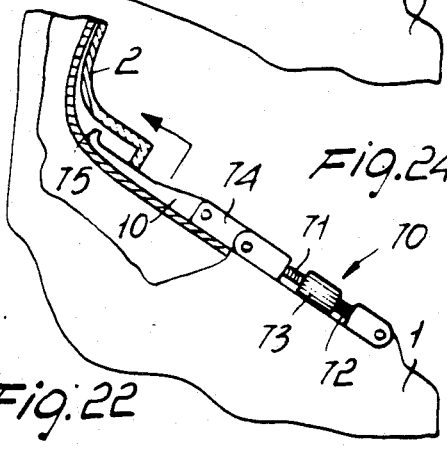
Fig. 24
Fig. 22

SKI BOOT INCORPORATING A FLEX CONTROL DEVICE

BACKGROUND OF THE INVENTION

This invention relates to a ski boot incorporating a flex control device.

As is known, a currently encountered problem in the making of ski boots is that of enabling the user to adjust the boots' flexibility as desired, flex being viewed herein as the resistance offered to the forward flexing of the quarter relatively to the boot shell, that is to the rotation of the quarter about a substantially horizontal transverse axis to the foot main direction.

The flex control devices currently in use are generally based on the use of variously calibrated elastic means which provide a force, adjustable at will, opposing the oscillation of the quarter with respect to the shell.

Such prior devices, additionally to being quite complicated and inconvenient to install, are posing serious problems of proper adjustment because outside temperature changes generally result in the set calibration values being altered significantly.

SUMMARY OF THE INVENTION

It is the aim of this invention to obviate such prior shortcomings by providing a ski boot incorporating a flex control device, which affords the possibility of adjusting the bias force opposing the oscillation of the quarter relatively to the shell by directly utilizing the inherent deformability characteristics of the elements which make up a traditional ski boot.

Within the above general aim, it is a particular object of the invention to provide a ski boot which allows accurate control of the boots' flexibility through the use of extremely simple means and without involving any substantial alteration of the typical construction of a ski boot.

A further object of this invention is to provide a ski boot as indicated, wherein flexibility can be adjusted without the use of elastic means which, in addition to being complicated to install, as mentioned, incur serious calibration problems.

The above aim, as well as these and other objects such as will be apparent hereinafter, are achieved by a ski boot incorporating a flex control device, according to the invention, which comprises a shell wherewith at least one quarter is associated, and is characterized in that it comprises at least one interference element acting between said shell and said at least one quarter, also provided being a means of changing the positioning of said at least one interference element, between said shell and said at least one quarter, to adjust the bias force and displacement of said at least one quarter with respect to said shell.

BRIEF DESCRIPTION OF THE DRAWINGS

Further features and advantages will be more clearly understood from the following description of some preferred, but not exclusive, embodiments of a ski boot incorporating a flex control device, with reference to the accompanying illustrative and not limitative drawings, where:

FIG. 1 is a perspective view of a ski boot showing a first embodiment of the flex control device;

FIG. 2 is a sectional view of the ski boot of FIG. 1 showing the flex control device as positioned for least bias and, accordingly, maximum flexibility;

FIG. 3 shows in section the ski boot of FIG. 1, as the positioning of the interference element is being changed;

FIG. 4 is a perspective view of the ski boot showing a second embodiment of the flex control device;

FIG. 19 shows a ski boot with a different flex control device, at an open position thereof during the phase of adjusting the positioning changing means for the interference element;

FIG. 20 is a side elevation, partly sectional view of the ski boot shown in FIG. 19;

FIG. 21 is a partly sectional side elevation view showing the ski boot of FIG. 19 in an operative position thereof;

FIG. 22 is a perspective view showing schematically a ski boot with a further embodiment of the flex control device;

FIG. 23 is a side elevation, partly cut-away view showing schematically the ski boot of FIG. 22 as the means of changing the positioning of the interference element are being adjusted;

FIG. 24 is a partly sectional view of the ski boot of FIG. 22 shown in its operative position

DESCRIPTION OF THE PREFERRED EMBODIMENTS

Figures 5, 6, 7, 8, 9:
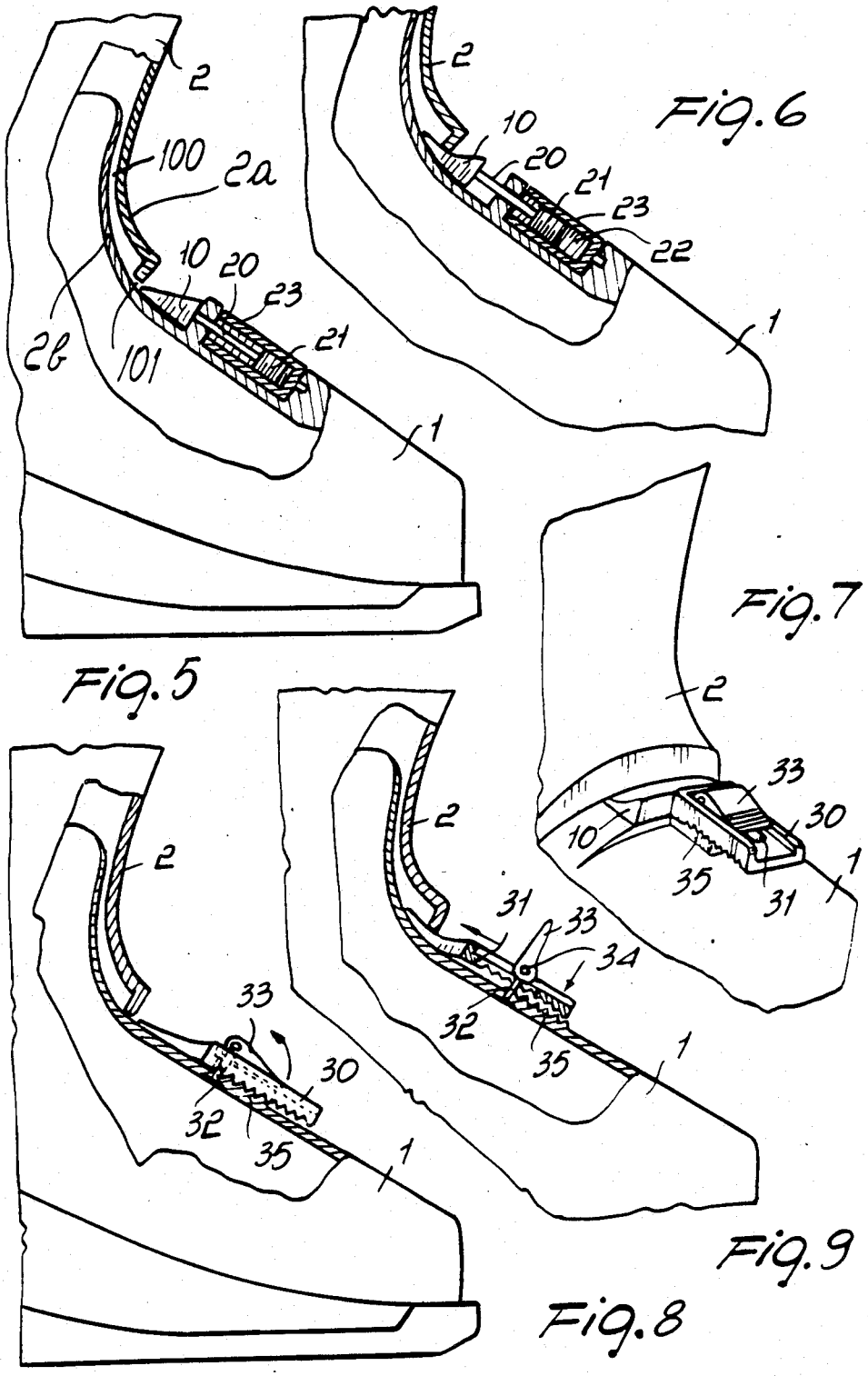
FIG. 5 is a partly cut-away view of the ski boot of FIG. 4, with the flex control device positioned for maximum flexibility.
FIG. 6 shows, partly in section, the ski boot of FIG. 4 with the flex control device positioned for a lesser amount of flexibility.
FIG. 7 is a detail view showing in perspective a ski boot with a third embodiment of this flex control device.
FIG. 8 shows, partly in cut-away view, the ski boot of FIG. 7, with the device adjusted for a lesser amount of flexibility.
FIG. 9 shows the ski boot of FIG. 7 during the device adjustment phase.
Figure 14:
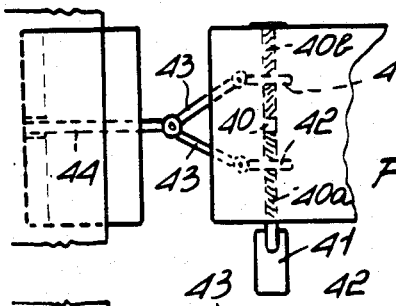
FIG. 14 is a schematical plan view of the device, in the position of FIG. 13.
Figure 12:
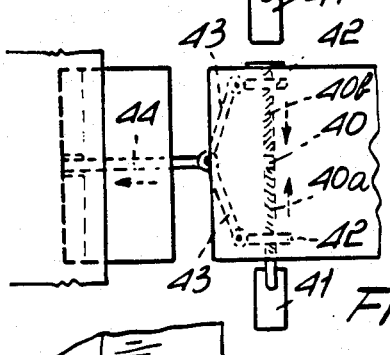
FIG. 12 is a schematical top plan view of this device.
Figure 11:
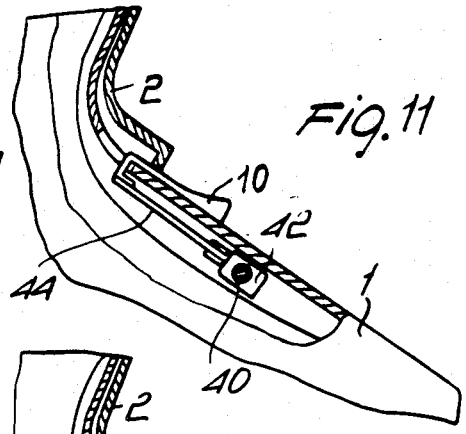
FIG. 11 is a partly sectional view of the ski boot of FIG. 10 with this device positioned for increased flexibility.
Figure 13:
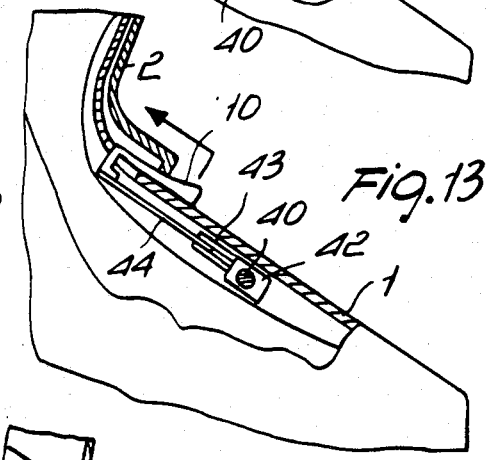
FIG. 13 is a partly sectional view of the ski boot of FIG. 10, with this device positioned for decreased flexibility.
Figure 10:
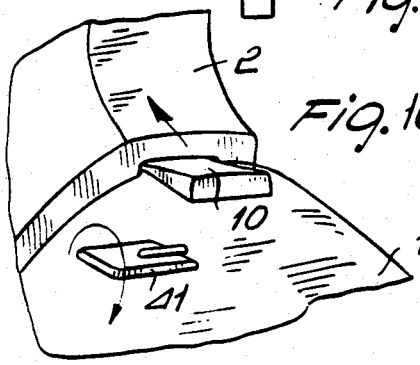
FIG. 10 is a perspective view of a ski boot, showing a fourth embodiment of the flex control device.
Figure 15:
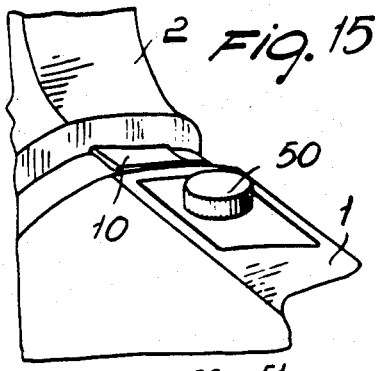
FIG. 15 shows schematically and in perspective a ski boot incorporating a further embodiment of this flex control device.
Figure 16:
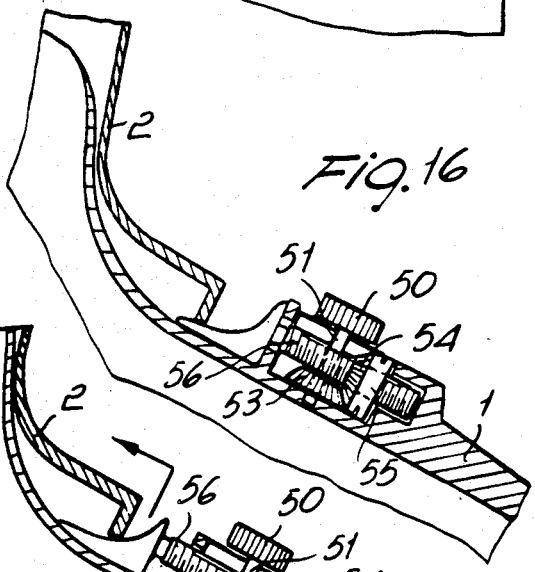
FIG. 16 shows in section the ski boot of FIG. 15, with the device adjusted for good flexibility.
Figure 17:
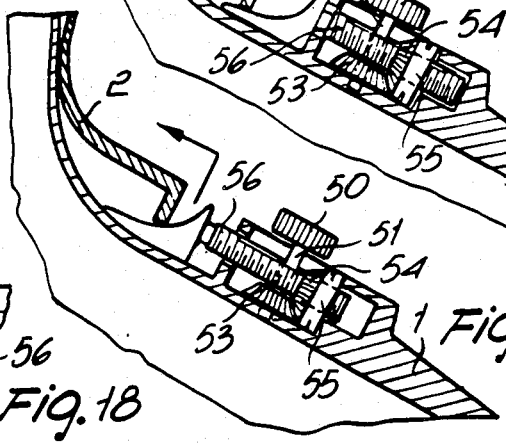
FIG. 17 is a sectional view of the ski boot of FIG. 15, showing the device adjusted for decreased flexibility.
Figure 18:
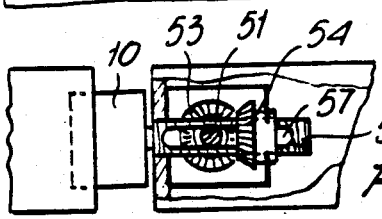
FIG. 18 is a plan view showing, partly in section, this device as installed on the ski boot of FIG. 15.

With reference to the drawing figures, and in particular to FIGS. 1 to 3, a ski boot incorporating a flex control device, according to the invention, which ski boot would advantageously be of the rear entrance type, comprises a shell 1 whereto a front quarter 2 and a rear quarter 3 are pivotally connected.

The quarters 2 and 3 can, as usual, oscillate about a substantially horizontal axis, transverse to the longitudinal direction of the user's foot.

The peculiar aspect of the invention is that between the shell 1 and front quarter 2, an interference element may be positioned in a variable fashion which, by interacting between the shell and quarter at the overlap area of the quarter on the shell, produces a greater or lesser bias force as dictated by the slidable positioning of the interference element, thereby increasing or decreasing the amount of flex, i.e. the force which should be applied to oscillate the front quarter about said horizontal axis. As best visible in FIG. 5, the overlapped portions 2*a* and 1*a* of the front quarter 2 and the shell 1 respectively form a gap 100 therebetween, with a gap aperture 101.

Advantageously, the interference element comprises a wedge-like body, indicated at 10, which has a variable thickness ranging from a minumum thickness normally smaller than the operative gap aperture (10) and a maximum thickness, normally greater than the operative gap aperture, is supported on the shell 1 and has its tapering end oriented to face the front quarter.

In the specific embodiment shown in FIGS. 1 to 3, the wedge-like element 10 is connected rigidly to a slider 11 constituting a transmission mechanism movable along a longitudinal rib 12 defining guiding surfaces provided on the front upper portion of the shell 1.

The slider 11 defines at the top a fin 13, advantageously formed integral with the slider, which has a grip lug 14 and engagement dog 15 adapted for removable insertion into any of the notches 17 formed in the longitudinal rib 12.

As dictated by the positioning of the slider 11, which constitutes the means of changing the positioning of the interference element formed of the wedge-like body 10, the wedge 10 will be pressed or will fit more or less deeply below the front edge of the front quarter 2, thus providing a greater or lesser friction between contacting surfaces, i.e. a bias force opposing the oscillatory movement of the front quarter 2 in a forward direction with respect to the shell.

Of course, the deeper the wedge 10 is pushed below the front quarter 2, and hence the greater is the thickness of the interference element acting between the quarter 2 and shell 1, the greater will be the friction and the bias force opposing the displacement movement consisting of the front quarter 2 oscillating with respect to the shell.

With reference to FIGS. 4 to 6, the wedge-like body 10 is connected to a rod 20 associated rigidly with a transmission mechanism comprising a threaded pawl 21 rotatively engaging with the interior of a threaded axial seat 22 defining guiding surfaces in a cylindrical body 23 which is advantageously knurled on the outside and supported rotatably on the shell 1.

The rotation of the cylinder or barrel 23 results in a guided translation in either direction of the threaded pawl 21, and consequently, a guided translation of the wedge 10 which will fit more or less deeply below the quarter, thereby establishing the same condition as described above.

With reference to FIGS. 7 to 9, the means of varying the positioning of the wedge 10 comprise a transmission mechanism constituted of a serrated slider 30 formed with a longitudinal guiding surfaces defining throughgoing slot 31 which is engaged in guiding relationship by a rod 32 having a small lever 33 journalled thereto which has a cam portion 34 acting by contact on the outer surface of the serrated slider 30, to clamp it against a fixed serration 35 provided on the shell 1.

By operating the small lever, as shown in FIG. 9, it becomes possible to release the connection between the serrated slider 30 and fixed serration 35 and produce, according to one's own requirements, a sliding movement of the slider 30 until a desired positioning of the wedge 10 below the front quarter 2 is achieved.

After the desired positioning is attained, it will be sufficient to turn the lever 33 which, with its eccentric cam portion 34, will press and lock the serrated slider 30 against the fixed serration 35.

With reference to FIGS. 10 to 14, the means of varying the positioning of the wedge 10 comprise here a transmission mechanism including a rod 40 having two oppositely handed guiding surfaces defining thread sections 40*a* and 40*b* and being rotatably supported on the shell 1 in a transverse direction to the longitudinal direction of the shell.

On one end of the rod 40, outside of the shell 1, there is provided a grip lug 41 which allows the rod 40 to be rotated.

On the rod 40, and specifically on the sections 40*a* and 40*b* thereof formed with oppositely handed threads, there are provided barrels 42 having a diametrical threaded hole and performing, as the rod 40 is rotated, a translatory movement in opposite directions along the rod.

Articulated to the barrels 42 are the ends of a pair of connecting rods 43 which are articulated with their other ends to a lug 44 connected, inside the shell 1, to the forward end of the wedge 10 which, like in the previous embodiments, is accommodated between the front quarter 2 and the shell.

On turning the rod 40, the barrels 42 are moved linearly and consequently, through the kinematic linkage formed by the connecting rods, the wedge 10 is moved to a greater or lesser depth below the front quarter 2, which results in a variation of the bias conditions.

With reference to FIGS. 15 to 18, a further embodiment of the means of varying the positioning of the interference element formed of the wedge 10 is shown therein, which comprises a transmission mechanism including a knob 50 accessible on the shell outside at an upper portion thereof and connected to a shaft 51 extending substantially perpendicularly to the shell and to which there is connected a first bevel gear 53, coaxial with the shaft 51 and meshing with a second bevel gear 54 supported against translation on a shoulder 55 defined by the shell and defining on its interior a guiding surface defining axial threaded seat in engagement with a threaded rod 56, perpendicular to the shaft 51 and defining a throughgoing hole 57 for the shaft to extend through.

The threaded rod 56 is connected to the wedge 10 such that on turning the knob, the preset coupling of the two bevel gears results in a translation in either direction of the threaded rod and consequently of the wedge 10 connected thereto with a more or less deep fitting thereof below the quarter 2.

With reference to FIGS. 19 to 21, the means of varying the positioning of the wedge 10 comprises a transmission mechanism including a variable length tie rod 60 having two guiding surfaces defining threaded sections 61 and 62 joined together by a rotatable threaded bushing 63 which can be turned to change the working length of the tie rod. The tie rod 60 is journalled with one end to the midlle portion of an actuating lever 65 articulated to the shell, and with the other end, the tie rod 60 is articulated to the wedge 10 which may be optionally, slidingly guided on the shell.

Depending on the working length set for the tie rod 60, the extent of the wedge 10 penetration below the quarter 2 can be adjusted at will, to again produce the bias adjustment conditions mentioned heretofore.

It should be also pointed out that the points of articulation of the tie rod on the wedge 10 and middle portion of the lever, as well as the articulation point of the lever to the shell, form in practice a three-hinge arc with the center hinge being formed by the tie rod-to-lever articulation which, in the locked condition shown in FIG. 21, would be positioned below a line joining the points of articulation of the lever to the shell and of the tie rod to the wedge 10, thereby any pushing force exerted on the wedge would tend to close the lever against the shell rather than open it inadventently.

With reference to FIGS. 22 to 24, there is shown a further embodiment of means for varying the positioning of the wedge, which comprise a transmission mechanism including an articulated body having a variable working length section 70 consisting of first and second guiding surfaces defining threaded sections 71 and 72 joined by a threaded sleeve 73 rotatably arranged for adjusting the working length of the threaded element 70 which is articulated at one end to the shell, and at the other end thereof, to an intermediate body 74 articulated, in turn, to the wedge 10 which has, on its tapering end, a bent over section 75 to prevent it from slipping out of the area underlying the front quarter 2.

In this case, the position of the wedge can be adjusted in a similar manner to that of the preceding embodiment, but without using a lever arm.

Also in this case, the pivot points are located such that the intermediate pivot point between the tie rod 70 and intermediate section 74 is positioned between the shell and a line joining the points of articulation of the intermediate section to the wedge 10 and of the tie rod to the shell, thereby any axial actions on the wedge would tend to move it toward the shell and not away from it.

As shown in FIG. 23, in order to effect the adjustment, it is sufficient that the articulated assembly be moved away from the shell, and that the threaded sleeve 73 be rotated until the desired positioning is achieved.

Figure 25:
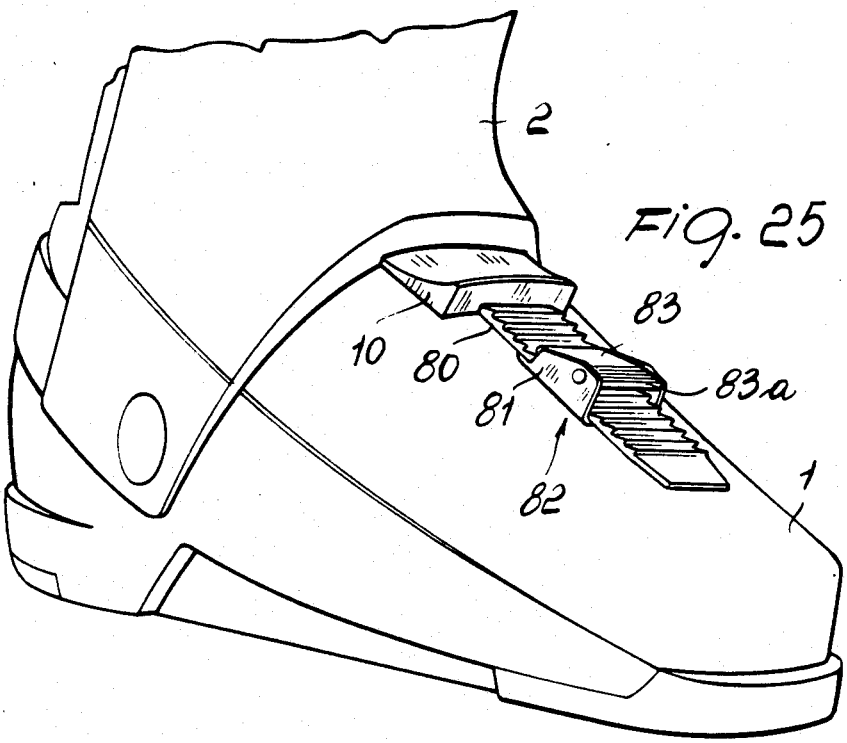
FIG. 25 shows the ski boot with a different embodiment of the flex control device.
Figure 26:
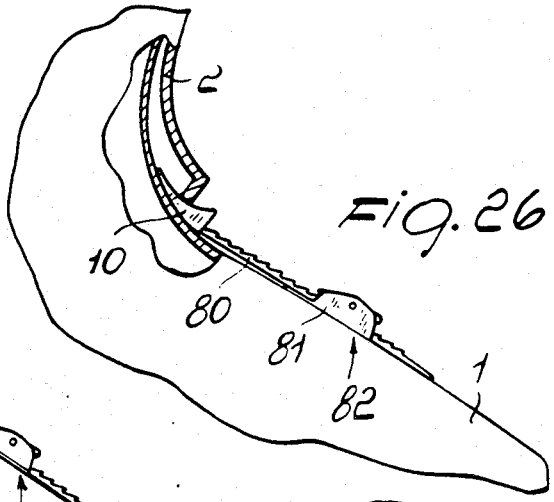
FIG. 26 shows, partly in section, the ski boot of FIG. 25 as adjusted for a small degree of flexibility.
Figure 27:
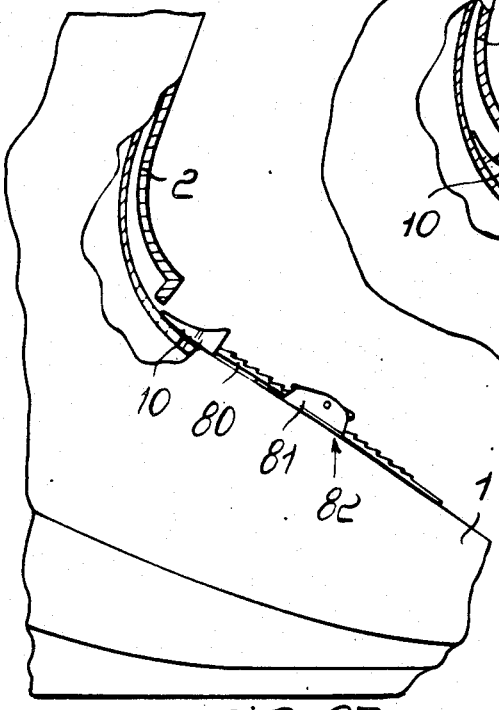
FIG. 27 shows the ski boot of FIG. 25 as adjusted for increased flexibility.

With reference to FIGS. 25 to 27, the wedge element 10 is connected to the end of a transmission mechanism including a serrated strap 80 which is received slidably between guiding surfaces defining arms 81 of a base 82 attached to the shell 1. The arms 81 support a rocking pawl 83 which is urged elastically with its serrated end against the serrated strap 80 to prevent the strap from slipping and the wedge 10 from moving in a wedge withdrawal direction. The pawl 83 has one end 83*a* operable to disengage its serrated end from the strap 80 and allow the strap to slip freely.

It may be appreciated from the foregoing that the invention achieves its objects, and in particular that a ski boot is provided wherein the flex control device makes no use of elastic elements, but merely of the greater or lesser interference of an interference element, advantageously composed of a wedge-like body which is inserted between the front quarter and shell such that, according to the position of the wedge-like body it produces a greater or lesser bias force opposing the oscillation of the front quarter relatively to the shell.

Specifically important is then the fact that in practice the inherent characteristic deformability which is typical of the element making up the presently used ski boots is utilized.

The invention herein is susceptible to many modifications and changes without departing from the purview of the inventive concept. Thus, as an example, the interfering element may be obtained with any other shimming arrangements however conformed, rather than with the wedge element, which may have an arcuated surface.

Figure 28:
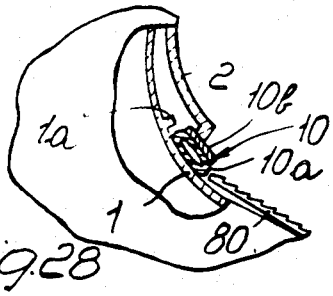
FIG. 28 shows a modified detail in section.

Thus, for example, as shown in FIG. 28, the interference element 10 may be constituted of a hose member 10*a* enclosing in a tight manner an air chamber therein, and having a plate member 10*b* fixed on the top thereof. An abutment ridge 1*a* may be provided on the shell portion 1 so that when the hose 10*a* is compressed between the ridge 1*a* and the pushing member 80, the hose expands upwardly the plate 10*a*, obtaining thereby the desired wedging effect.

Furthermore, all of the details may be replaced with other technically equivalent elements.

In practicing the invention, any materials, as well as the dimensions and contingent shapes, may be used to suit individual requirements.

We claim:

1. In a ski boot having a shell and at least one quarter associated with said shell, said shell and said quarter having mutually overlapping portions thereof defining a gap with an operative aperture therebetween, a flex control device comprising, at least one interference element having a variable thickness ranging from a minimum thickness normally smaller than the operative aperture of said gap and a maximum thickness normally greater than the operative aperture of said gap, said interference element being insertable into said gap and slidable therein, means of changing the positioning of said at least one interference element, comprising a transmission mechanism including guiding surfaces for slidably guiding said interference element in a direction towards and alternatively away from said gap to adjustably press and alternatively release said interference element into and from said gap respectively to thereby adjust the friction between said interference element and said shell and quarter, and adjust thereby the bias force opposing the displacement of said quarter with respect to said shell.

2. In a ski boot having a shell and at least one quarter including a front quarter associated with said shell, said shell and said front quarter having mutually overlapping portions thereof defining a gap with an aperture therebetween, a flex control device comprising, at least one interference element in the form of a wedge-like element having a variable thickness ranging from a minimum thickness normally smaller than the aperture of said gap and a maximum thickness normally greater than the aperture of said gap, said wedge-like element being insertable into said gap and slidable therein, means of changing the positioning of said wedge-like element, comprising a transmission mechanism including guiding surfaces for slidably guiding said wedge-like element in a direction towards and alternatively away from said gap to adjustably push and alternatively release said wedge-like element into and from said gap respectively to thereby adjust the friction between said wedge-like element and said shell and front quarter, and adjust thereby the bias force opposing the displacement of said front quarter with respect to said shell.

3. A ski boot incorporating a flex control device, according to claim 2, wherein said means of changing the positioning of said at least one interference element comprises a slider supporting said at least one interference element and being movable along a longitudinal rib provided on said shell, said slider supporting a fin having a grip lug and an engagement dog insertable elastically into spaced apart notches defined by said longitudinal rib.

4. A ski boot incorporating a flex control device, according to claim 2, wherein said means of changing the positioning of said at least one interference element, comprise a rod connected thereto a threaded pawl supported by said rod, a cylindrical body supported rotatably on said shell and having a threaded seat defined therein, said threaded pawl being engaged in said threaded seat for translatory movement thereof upon rotation of said cylinder body.

5. A ski boot incorporating a flex control device, according to claim 2, wherein said means of changing the positioning of said at least one interference element comprise a serrated slider supporting said at least one interference element and being arranged to overlap a fixed serration provided on said shell, also provided being a means of removably clamping said serrated slider against said fixed serration.

6. A ski boot incorporating a flex control device, according to claim 5, wherein said means of removably clamping said serrated slider comprise a small lever articulated at an end thereof to a rod projecting from said shell and being passed through a longitudinal slot defined on said serrated slider, said lever being provided with an accentric cam acting by contact on said serrated slider to releasably clamp it against said fixed serration.

7. A ski boot incorporating a flex control device, according to claim 2, wherein said means of changing the positioning of said at least one interference element comprise a rod supported rotatably transversely to said shell and provided with oppositely handed thread sections, with said oppositely handed thread sections there engaging barrels having a threaded diametrical hole, to said barrels there being articulated the ends of a pair of connecting rods journalled at the other ends to a lug connected to said at least one interference element.

8. A ski boot incorporating a flex control device, according to claim 2, wherein said means of changing the positioning of said at least one interference element comprise a knob reachable from the outside of said shell and connected to a shaft journalled about a substantially perpendicular axis to said shell and connected rigidly to a first bevel gear meshing with a second bevel gear supported rotatably against translation about a substantially perpendicular axis to said shaft, said second bevel gear defining an axial threaded seat wherein there engages a threaded rod connected to said at least one interference element, said threaded rod defining a throughgoing slot wherein said shaft is received.

9. A ski boot incorporating a flex control device, according to claim 2, wherein said means of changing the positioning of said at least one interference element comprise a tie rod having a variable working length and being pivotally connected with one end to a middle portion of an actuating lever journalled on said shell, and with the other end, to said at least one interference element.

10. A ski boot incorporating a flex control device, according to claim 2, wherein said means of changing the positioning of said at least one interference element comprise a variable working length section pivoted with one end to said shell and with the other end to an intermediate body pivotally connected to said at least one interference element, said at least one interference element having at its tapering end receivable below said quarter a bent over section adapted to prevent slipping out of the area below the forward edge of said at least one quarter.

11. A ski boot incorporating a flex control device, according to claim 2, wherein said means of changing the positioning of said at least one interference element comprise a serrated strap connected to said at least one interference element and engageable slidably between arms of a base attached to said shell and carrying a rocking pawl removably elastically coupleable with one serrated end thereof to said serrated strap to prevent said serrated strap from moving in a direction away from said at least one interference element.

* * * * *